US007725948B2

(12) United States Patent
Steindorf

(10) Patent No.: US 7,725,948 B2
(45) Date of Patent: Jun. 1, 2010

(54) FACE MASK WITH OFFSET FOLDING FOR IMPROVED FLUID RESISTANCE

(75) Inventor: Eric Clayton Steindorf, Roswell, GA (US)

(73) Assignee: Kimberly-Clark Woldwide, Inc., Neenah, WI (US)

( * ) Notice: Subject to any disclaimer, the term of this patent is extended or adjusted under 35 U.S.C. 154(b) by 1088 days.

(21) Appl. No.: 11/020,738

(22) Filed: Dec. 22, 2004

(65) Prior Publication Data

US 2006/0130214 A1 Jun. 22, 2006

(51) Int. Cl.
*A41D 13/00* (2006.01)

(52) U.S. Cl. ..... 2/9; 2/206

(58) Field of Classification Search ..... 128/206.19, 128/206.12, 206.13; 2/424, 9, 206
See application file for complete search history.

(56) References Cited

U.S. PATENT DOCUMENTS 3,338,992 A 8/1967 Kinney
3,341,394 A 9/1967 Kinney
3,502,763 A 3/1970 Hartmann
3,542,615 A 11/1970 Dobo et al.
3,692,618 A 9/1972 Dorschner et al.
3,802,817 A 4/1974 Matsuki et al.
3,849,241 A 11/1974 Butin et al.
3,884,227 A * 5/1975 Lutz et al. ..... 128/206.19
3,953,566 A 4/1976 Gore
4,100,324 A 7/1978 Anderson et al.
4,187,390 A 2/1980 Gore
4,215,682 A 8/1980 Kubik et al.
4,259,748 A 4/1981 Miller
4,340,563 A 7/1982 Appel et al.
4,374,888 A 2/1983 Bornslaeger
4,375,718 A 3/1983 Wadsworth et al.
4,443,513 A 4/1984 Meitner et al.
4,592,815 A 6/1986 Nakao
4,631,933 A 12/1986 Carey, Jr.
4,652,487 A 3/1987 Morman
4,655,760 A 4/1987 Morman et al.
4,657,802 A 4/1987 Morman
4,720,415 A 1/1988 Vander Wielen et al.
4,781,966 A 11/1988 Taylor
4,789,699 A 12/1988 Kieffer et al.
4,802,473 A 2/1989 Hubbard et al.
4,818,464 A 4/1989 Lau
4,874,659 A 10/1989 Ando et al.

(Continued)

OTHER PUBLICATIONS

U.S. Appl. No. 10/970,457, filed Oct. 21, 2004.

(Continued)

*Primary Examiner*—Shaun R Hurley
*Assistant Examiner*—Andrew W Sutton
(74) *Attorney, Agent, or Firm*—Dority & Manning, P.A.

(57) ABSTRACT

A face mask for improved fluid resistance is provided. The face mask may include a body portion with a first layer and a second layer. The first and second layers may have a plurality of folds that form a plurality of first creases in the first layer and a plurality of second creases in the second layer. The body portion may have an outer facing surface and an inner facing surface opposite from the outer facing surface. At least one of the first creases may be misaligned with at least one of the second creases in order to provide improved fluid resistance of the body portion.

14 Claims, 7 Drawing Sheets

U.S. PATENT DOCUMENTS 4,891,957 A 1/1990 Strack et al.
4,965,122 A 10/1990 Morman
4,969,457 A 11/1990 Hubbard et al.
4,981,747 A 1/1991 Morman
5,020,533 A 6/1991 Hubbard et al.
5,114,781 A 5/1992 Morman
5,226,992 A 7/1993 Morman
5,244,482 A 9/1993 Hassenboehler, Jr. et al.
5,322,061 A 6/1994 Brunson
5,336,545 A 8/1994 Morman
5,383,450 A 1/1995 Hubbard et al.
5,401,466 A 3/1995 Foltz et al.
5,492,753 A 2/1996 Levy et al.
5,493,753 A 2/1996 Rostamo
5,540,976 A 7/1996 Shawver et al.
5,553,608 A 9/1996 Reese et al.
5,681,645 A 10/1997 Strack et al.
5,699,791 A * 12/1997 Sukiennik et al. ..... 128/206.13
5,813,398 A 9/1998 Baird et al.
6,062,220 A 5/2000 Whitaker et al.
6,412,486 B1 * 7/2002 Glass ..... 128/206.19
6,474,336 B1 * 11/2002 Wolfe ..... 128/206.21
6,484,722 B2 11/2002 Bostock et al.
6,520,181 B2 2/2003 Baumann et al.
6,644,314 B1 11/2003 Elsberg
6,827,764 B2 * 12/2004 Springett et al. ..... 96/66
2004/0078869 A1 4/2004 Bell et al.
2004/0121107 A1 6/2004 Bell et al.
2004/0237964 A1 * 12/2004 Bostock et al. ..... 128/206.19
2006/0137691 A1 * 6/2006 Kleman et al. ..... 128/206.19

OTHER PUBLICATIONS

U.S. Appl. No. 10/743,260, filed Dec. 22, 2003.
U.S. Appl. No. 11/022,379, filed Dec. 21, 2004.
U.S. Appl. No. 11/020,734, filed Dec. 22, 2004.
U.S. Appl. No. 11/021,543, filed Dec. 23, 2004.

* cited by examiner

FACE MASK WITH OFFSET FOLDING FOR IMPROVED FLUID RESISTANCE

BACKGROUND

Face masks find utility in a variety of medical, industrial and household applications by protecting the wearer from inhaling dust and other harmful airborne contaminates through their mouth or nose. Likewise, the use of face masks is a recommended practice in the healthcare industry to help prevent the spread of disease. Face masks worn by healthcare providers help reduce infections in patients by filtering the air exhaled from the wearer thus reducing the number of harmful organisms or other contaminants released into the environment. Additionally, face masks protect the healthcare worker by filtering airborne contaminants and microorganisms from the inhaled air.

The section of the face mask that covers the nose and mouth is typically known as the body portion. The body portion of the mask may be comprised of several layers of material. At least one layer may be composed of a filtration material that prevents the passage of germs and other contaminants therethrough but allows for the passage of air so that the user may comfortably breathe. The porosity of the mask refers to how easily air is drawn through the mask. A more porous mask is easier to breathe through. The body portion may also contain multiple layers to provide additional functionality or attributes to the face mask. For example, many face masks include one or more layers of material on either side of the filtration media layer. Further components may be attached to the mask to provide additional functionality. A clear plastic face shield intended to protect the user's face from splashed fluid is one example.

As stated, face masks may be designed to be resistant to penetration by splashes of fluids so that pathogens found in blood or other fluids may not be able to be transferred to the nose, mouth, and/or skin of the user of the face mask. The American Society of Testing and Materials has developed test method F-1862, *"Standard Test Method of Resistance of Medical Face Masks to Penetration by Synthetic Blood* (Horizontal Projection of Fixed Volume at a Known Velocity)" to assess a face mask's ability to resist penetration by a splash. The splash resistance of a face mask is typically a function of the ability of the layer or layers of the face mask to resist fluid penetration, and/or their ability to reduce the transfer of the energy of the fluid splash to subsequent layers, and/or by their ability to absorb the energy of the splash. Typical approaches to improving fluid resistance are to use thicker materials or additional layers in the construction of the face mask. However, these solutions may increase the cost of the face mask and reduce the porosity of the face mask.

Referring to the prior art configuration of FIGS. 1 and 2, the body portion 12 of face masks 10 are typically manufactured with horizontal folds 22 and 26 so that the body portion 12 may be adjusted vertically or otherwise to allow the body portion 12 to be formed into a chamber with the perimeter of the chamber sealing to the face of the user. All of the layers 20 and 24 of the body portion 12 are folded simultaneously during manufacture of the face mask 10. Creases 56 and 58 in the layers 20 and 24 of the body portion 12 are therefore nested or aligned with one another both before unfolding of the body portion 12, as shown in FIG. 1, and after unfolding as shown in FIG. 2. It is sometimes the case that the layers 20 and 24 are adhered to one another before folding. Folding of the layers 20 and 24 independently from one another is not done as this technique allegedly adds cost and complexity to the manufacturing process.

Inspection of face masks 10 that fail to meet certain criteria of the F-1862 method has shown a higher rate of failure when fluid impacts the creases 56 and 58 that are placed into the body portion 12. The folding process weakens the body portion 12 at the creases 56 and 58 and in turn makes this area more susceptible to fluid penetration. Additionally, the completely nested configuration of the creases 56 and 58 brings the individual layers 20 and 24 together with one another thus allowing more energy and fluid to be transferred from one layer to the next during a fluid splash.

SUMMARY

Various features and advantages of the invention will be set forth in part in the following description, or may be obvious from the description, or may be learned from practice of the invention.

One exemplary embodiment provides for a face mask that is configured to have improved fluid resistance. The face mask may include a body portion with a first layer and a second layer where both the first and second layers have a plurality of folds that form a plurality of first creases in the first layer and a plurality of second creases in the second layer. The body portion may have an outer facing surface and an inner facing surface opposite from the outer facing surface. At least one of the first creases may be misaligned with at least one of the second creases. This type of configuration may be advantageous in that fluid may not be allowed to travel directly through at least one of the first and second creases because these creases are not nested or in alignment with one another.

In accordance with another exemplary embodiment, a face mask may be provided that includes a body portion configured to be placed over a mouth and at least part of a nose of a user in order to isolate the mouth and at least part of the nose of the user from the environment. The body portion may have a first layer with a plurality of folds forming a plurality of first creases in which the folds extend across the entire horizontal length of the first layer and are configured to unfold in order to extend the length of the first layer in the vertical direction. The body portion may also have a second layer adjacent with the first layer with a plurality of folds that form a plurality of second creases. The folds of the second layer may extend across the entire horizontal length of the second layer and may be configured to unfold in order to extend the length of the second layer in the vertical direction. The first creases of the plurality of folds in the first layer may be unnested with the second creases of the plurality of folds in the second layer.

In accordance with another exemplary embodiment, a face mask may be provided as discussed above in which all of the first creases of the first layer may be unnested or misaligned with the second creases of the second layer.

Another exemplary embodiment of the face mask exists as discussed above where the body portion may have binding on at least two of the ends of the first and second layers. In accordance with yet another exemplary embodiment, the binding may act to limit expansion of the edges of the first and second layers upon unfolding of the folds in the first and second layers.

A further exemplary embodiment of the face mask as discussed above is provided that may include a fastening member. The fastening member may be attached to the body portion and may be configured for retaining the body portion onto the face of the user. In accordance with a further exemplary embodiment, the fastening member may be a pair of manual tie straps or ear loops.

Also provided for in accordance with yet another exemplary embodiment is a face mask as previously discussed where the body portion may have a third layer in contact with the second layer. The third layer may have a plurality of folds that form a plurality of third creases. The third layer may form the inner facing surface of the body portion and the first layer may form the outer facing surface of the body portion. Additionally, at least one of the first creases of the first layer may be misaligned with all of the third creases.

Also provided for in accordance with another exemplary embodiment is a method of producing a body portion of a face mask. The method may include the steps of providing a first layer and a second layer. The method may also include the step of folding the first layer so as to form a plurality of folds with a plurality of first creases. Additionally, the method may include the step of folding the second layer separately from the first layer so as to form a plurality of folds with a plurality of second creases in the second layer. Also included in the method may be the step of assembling the first layer and the second layer into a body portion of a face mask so that at least one of the first creases is misaligned with the second creases.

Also provided for in another exemplary embodiment is a method as previously discussed where the step of assembling includes binding at least two of the ends of the first layer to two of the ends of the second layer.

Another exemplary embodiment resides in a method as previously discussed that further includes the steps of providing a third layer and folding the third layer. The third layer may be folded so as to form a plurality of folds with a plurality of third creases in the third layer. The method may also include the step of assembling the third layer with the first and second layers into a body portion of a face mask so that at least one of the first creases in the first layer is misaligned with the third creases.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
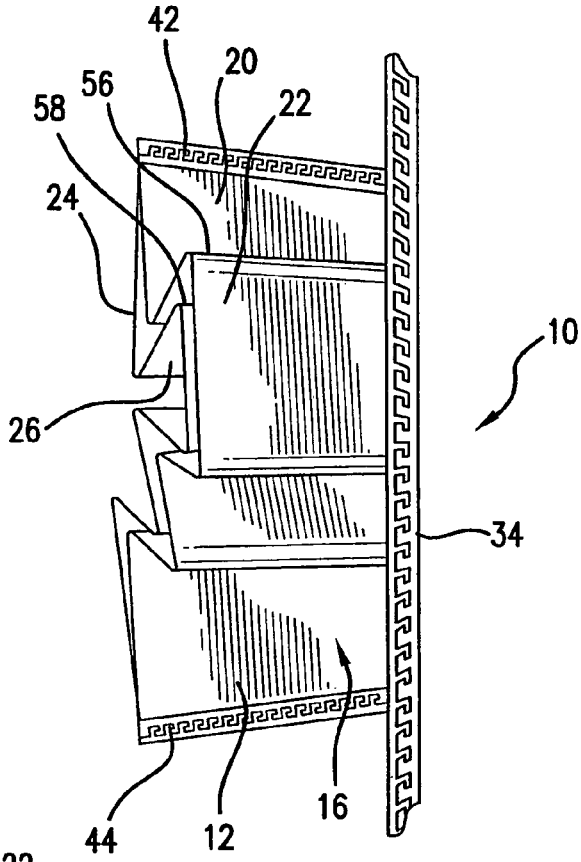
FIG.1 PRIOR ART
FIG. 1 is a partial perspective view of a body portion of a prior face mask with layers having aligned creases in the closed orientation.
Figure 2:
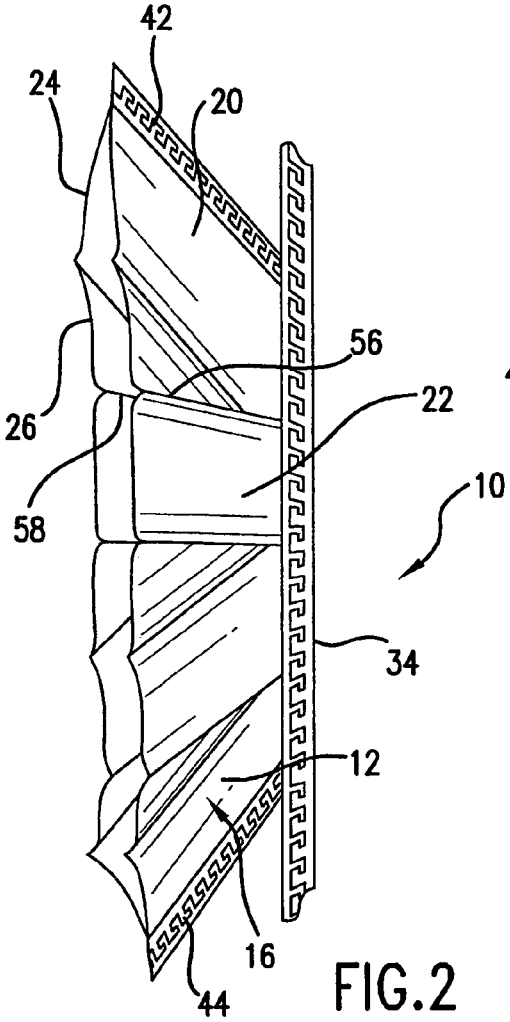
FIG.2 PRIOR ART
FIG. 2 is a partial perspective view of the body portion of FIG. 1 in the opened orientation.

Repeat use of reference characters in the present specification and drawings is intended to present same or analogous features or elements of the invention.

DEFINITIONS

As used herein, the term "nonwoven fabric or web" means a web having a structure of individual fibers or threads which are interlaid, but not in an identifiable manner as in a knitted fabric. Nonwoven fabrics or webs have been formed from various processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

As used herein, the term "ultrasonic bonding" refers to a process in which materials (fibers, webs, films, etc.) are joined by passing the materials between a sonic horn and anvil roll. An example of such a process is illustrated in U.S. Pat. No. 4,374,888 to Bornslaeger, the entire contents of which are incorporated herein by reference in their entirety for all purposes.

As used herein, the term "thermal point bonding" involves passing materials (fibers, webs, films, etc.) to be bonded between a heated calender roll and a heated anvil roll. The calender roll is usually, though not always, engraved with a pattern in some way such that the entire fabric is not bonded across its entire surface. The surface of the anvil roll is usually flat and/or smooth. As a result, various patterns for calender rolls have been developed for functional as well as aesthetic reasons. Typically, the percent bonding area varies from around 10 percent to around 30 percent of the area of the fabric laminate. The bonded areas are typically discrete points or shapes and not interconnected. As is well known in the art, thermal point bonding holds the laminate layers together and imparts integrity and strength to the nonwoven material by bonding filaments and/or fibers together thereby limiting their movement.

As used herein, the term "electret" or "electret treating" refers to a treatment that imparts a charge to a dielectric material, such as a polyolefin. The charge includes layers of positive or negative charges trapped at or near the surface of the polymer, or charge clouds stored in the bulk of the polymer. The charge also includes polarization charges which are frozen in alignment of the dipoles of the molecules. Methods of subjecting a material to electret treating are well known by those skilled in the art. These methods include, for example, thermal, liquid-contact, electron beam, and corona discharge methods. One particular technique of subjecting a material to electret treating is disclosed in U.S. Pat. No. 5,401,466 to Foltz, the entire contents of which are herein incorporated by reference in their entirety for all purposes. This technique involves subjecting a material to a pair of electrical fields wherein the electrical fields have opposite polarities.

As used herein, the term "spunbonded fibers" refers to small diameter fibers which are formed by extruding molten thermoplastic material as filaments from a plurality of fine, usually circular capillaries of a spinneret with the diameter of the extruded filaments then being rapidly reduced to fibers as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al., the entire contents of which are incorporated herein by reference in their entirety for all purposes. Spunbond fibers are generally continuous and have diameters generally greater than about 7 microns, more particularly, between about 10 and about 40 microns.

As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al., the entire contents of which are incorporated herein by reference in their entirety for all purposes. Meltblown fibers are microfibers which may be continuous or discontinuous with diameters generally less than 10 microns.

As used herein, the term "stretch bonded laminate" refers to a composite material having at least two layers in which one layer is a gatherable layer and the other layer is an elastic layer. The layers are joined together when the elastic layer is extended from its original condition so that upon relaxing the layers, the gatherable layer is gathered. Such a multilayer composite elastic material may be stretched to the extent that the nonelastic material gathered between the bond locations allows the elastic material to elongate. One type of stretch bonded laminate is disclosed, for example, by U.S. Pat. No. 4,720,415 to Vander Wielen et al., the entire contents of which are incorporated herein by reference in their entirety for all purposes. Other composite elastic materials are disclosed in U.S. Pat. No. 4,789,699 to Kieffer et al., U.S. Pat. No. 4,781,966 to Taylor and U.S. Pat. Nos. 4,657,802 and 4,652,487 to Morman and U.S. Pat. No. 4,655,760 to Morman et al., the entire contents of which are incorporated herein by reference in their entirety for all purposes.

As used herein, the terms "necking" or "neck stretching" interchangeably refer to a method of elongating a nonwoven fabric, generally in the machine direction, to reduce its width (cross-machine direction) in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.6 times. When relaxed, the web retracts toward, but does not return to, its original dimensions. Such a process is disclosed, for example, in U.S. Pat. No. 4,443,513 to Meitner and Notheis, U.S. Pat. Nos. 4,965,122, 4,981,747 and 5,114,781 to Morman and U.S. Pat. No. 5,244,482 to Hassenboehler Jr. et al., the entire contents of which are incorporated herein by reference in their entirety for all purposes.

As used herein, the term "necked material" refers to any material which has undergone a necking or neck stretching process.

As used herein, the term "reversibly necked material" refers to a material that possesses stretch and recovery characteristics formed by necking a material, then heating the necked material, and cooling the material. Such a process is disclosed in U.S. Pat. No. 4,965,122 to Morman, the entire contents of which are incorporated by reference herein in their entirety for all purposes.

As used herein, the term "neck bonded laminate" refers to a composite material having at least two layers in which one layer is a necked, non-elastic layer and the other layer is an elastic layer. The layers are joined together when the non-elastic layer is in an extended (necked) condition. Examples of neck-bonded laminates are such as those described in U.S. Pat. Nos. 5,226,992, 4,981,747, 4,965,122 and 5,336,545 to Morman, the entire contents of which are incorporated herein by reference in their entirety for all purposes.

As used herein, the term "coform" means a meltblown material to which at least one other material is added during the meltblown material formation. The meltblown material may be made of various polymers, including elastomeric polymers. Various additional materials may be added to the meltblown fibers during formation, including, for example, pulp, superabsorbent particles, cellulose or staple fibers. Coform processes are illustrated in commonly assigned U.S. Pat. No. 4,818,464 to Lau and U.S. Pat. No. 4,100,324 to Anderson et al., the entire contents of which are incorporated herein by reference in their entirety for all purposes.

As used herein, the term "elastic" refers to any material, including a film, fiber, nonwoven web, or combination thereof, which upon application of a biasing force, is stretchable to a stretched, biased length which is at least about 150 percent, or one and a half times, its relaxed, unstretched length, and which will recover at least 15 percent of its elongation upon release of the stretching, biasing force.

As used herein, the term "extensible and retractable" refers to the ability of a material to extend upon stretch and retract upon release. Extensible and retractable materials are those which, upon application of a biasing force, are stretchable to a stretched, biased length and which will recover a portion, preferably at least about 15 percent, of their elongation upon release of the stretching, biasing force.

As used herein, the terms "elastomer" or "elastomeric" refer to polymeric materials that have properties of stretchability and recovery.

As used herein, the terms "stretch" or "stretched" refers to the ability of a material to extend upon application of a biasing force. Percent stretch is the difference between the initial dimension of a material and that same dimension after the material has been stretched or extended following the application of a biasing force. Percent stretch may be expressed as [(stretched length B initial sample length)/initial sample length]×100. For example, if a material having an initial length of one (1) inch is stretched 0.50 inch, that is, to an extended length of 1.50 inches, the material can be said to have a stretch of 50 percent.

As used herein, the term "recover" or "recovery" refers to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches the material would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the term "composite" refers to a material which may be a multicomponent material or a multilayer material. These materials may include, for example, spunbonded-meltblown-spunbonded, stretch bonded laminates, neck bonded laminates, or any combination thereof.

As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

These terms may be defined with additional language in the remaining portions of the specification.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges and limits mentioned herein include all ranges located within, and also all values located under or above the prescribed limits. It is to be also understood that all ranges mentioned herein include all subranges included in the mentioned ranges. For instance, a range from 100-200 also includes ranges from 110-150, 170-190, and 153-162. Further, all limits mentioned herein include all other limits included in the mentioned limit. For example, a limit of up to about 7 also includes a limit of up to about 5, up to about 3, and up to about 4.5.

In accordance with one exemplary embodiment, a face mask 10 is provided that has a body portion 12 that includes both a first and second layer 20 and 24. The first and second layers 20 and 24 may be arranged so that a plurality of first creases 56 in the folds 22 are misaligned or unnested from a plurality of second creases 58 in the folds 26. Misaligning or unnesting of the creases 56 and 58 may improve the fluid resistance of the body portion 12 because doing so will eliminate a potential weak spot in the body portion 12 in that fluid may be prevented from contacting and traveling through the body portion 12 directly from one crease 56 to the other crease 58.

Figure 3:
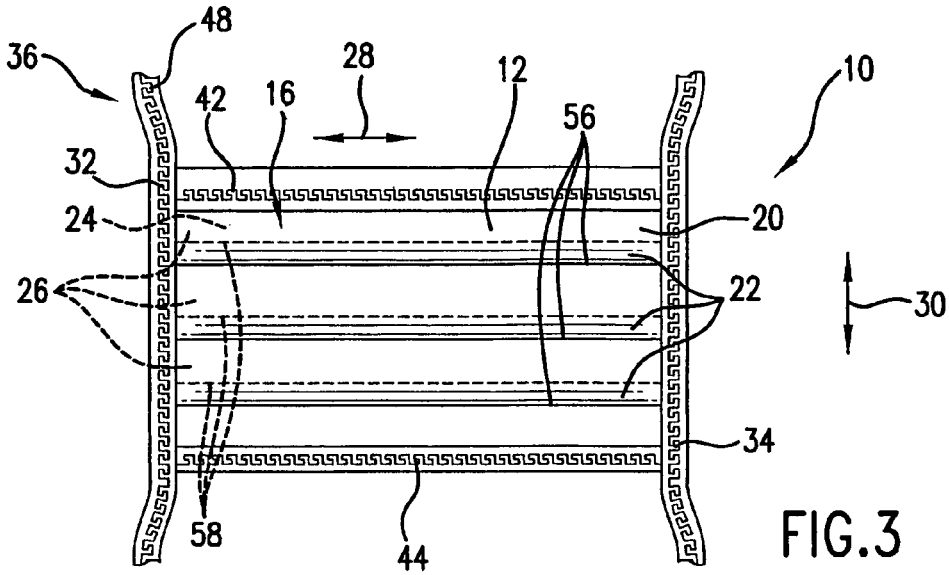
FIG. 3 is a front view of an exemplary embodiment of a face mask in accordance with one exemplary embodiment.

FIG. 3 shows a front view of the face mask 10 in accordance with one exemplary embodiment. The body portion 12 may have a first layer 20 with a plurality of folds 22 that extend in a horizontal direction 28. Likewise, the body portion 12 may have a second layer 24 with a plurality of folds 26 that also extend in the horizontal direction 28. A plurality of first creases 56 in the folds 22 may be vertically offset from a plurality of creases 58 in the folds 26 in a vertical direction 30.

Figure 4:
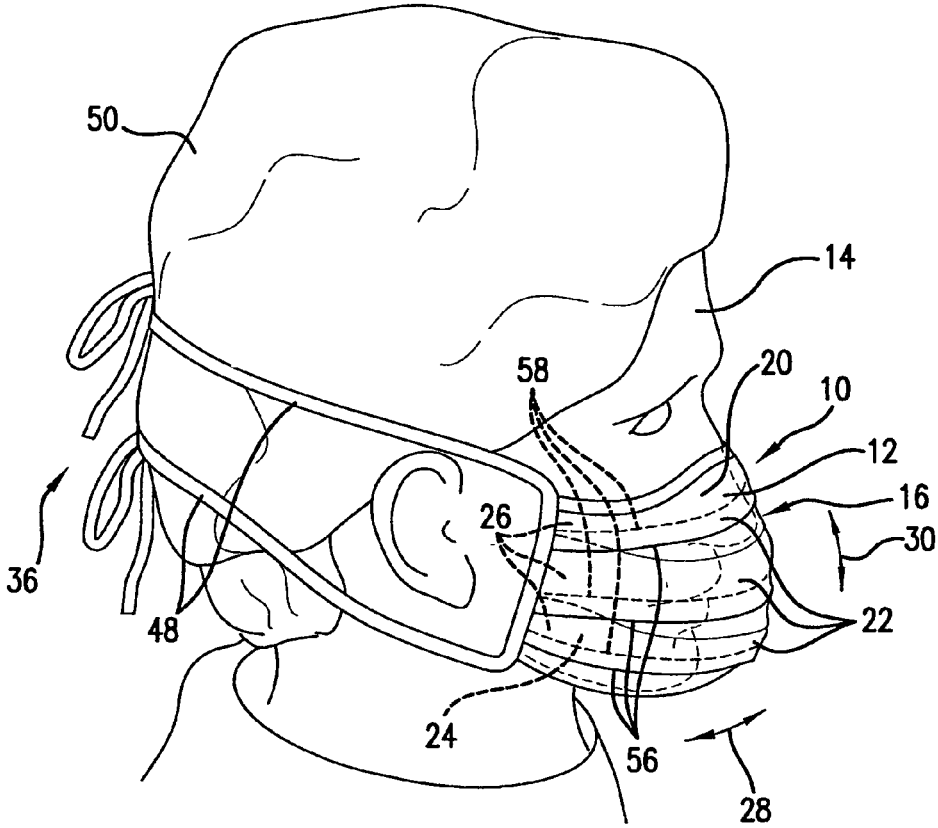
FIG. 4 is a perspective view of the face mask of FIG. 3 shown attached to the face of a user.

The body portion 12 may be configured to be placed over the mouth and at least part of the nose of the user 14 as shown in FIG. 4 so that air exchange through normal respiration passes through the body portion 12. The user 14 may unfold the folds 22 and 26 so as to increase the length of the body portion 12 in the vertical direction 30 in order to conform the shape of the body portion 12 to the user's 14 face. The body portion 12 may be formed into a chamber with the perimeter of the chamber sealing to the face of the user 14. As shown in the open position in FIG. 4, the plurality of first creases 56 will be offset from the plurality of second creases 58 so as to improve fluid strike through concerning fluid that contacts the outer facing surface 16 of the body portion 12 and propagates through to an inner facing surface 18 of the body portion 12 that may contact the face of the user 14.

Although all of the first creases 56 may be misaligned or unnested with the second creases 58 in accordance with various exemplary embodiments, it is to be understood that in accordance with other exemplary embodiments only one or more of the first creases 56 may be misaligned or unnested with the second creases 58. Additionally, the creases 56 and 58 may be made in the layers 20 and 24 such that they are not completely parallel to one another but may be at angles so as to intersect. In this regard, one or more of the first creases 56 may intersect one or more of the second creases 58 at one or more locations.

Figure 5:
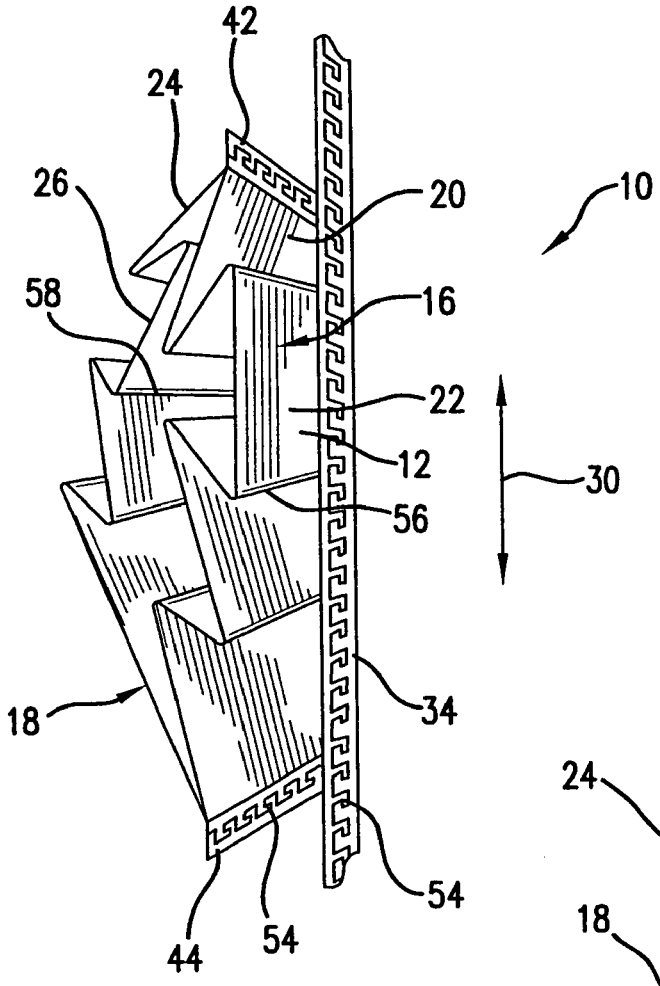
FIG. 5 is a partial perspective view of a body portion of a face mask in accordance with one exemplary embodiment that has layers in the closed orientation with creases that are misaligned with one another.

FIG. 5 is a partial cut-a-way view of an exemplary embodiment of the face mask 10 in which the body portion 12 is in the closed or unopened positioned. The plurality of folds 22 and 26 in the first and second layers 20 and 24 may be of any type commonly known to those having ordinary skill in the art. The side edges of the first and second layers 20 and 24 may be held together, for example, by ultrasonic bonding, as represented by ultrasonic bond dimples 54. It is to be understood that other ultrasonic bonding patterns may be employed to facilitate holding of the sides of the layers 20 and 24 to one another. FIG. 3 shows binding 32 and 34 on either side of the body portion 12 that is used to constrain the layers 20 and 24. Additionally, binding 42 may be located on the top edge of the body portion 12 and binding 44 may be located on the bottom edge of the body portion 12. The bindings 32, 34, 42 and 44 may be of various types in accordance with other exemplary embodiments.

Figure 6:
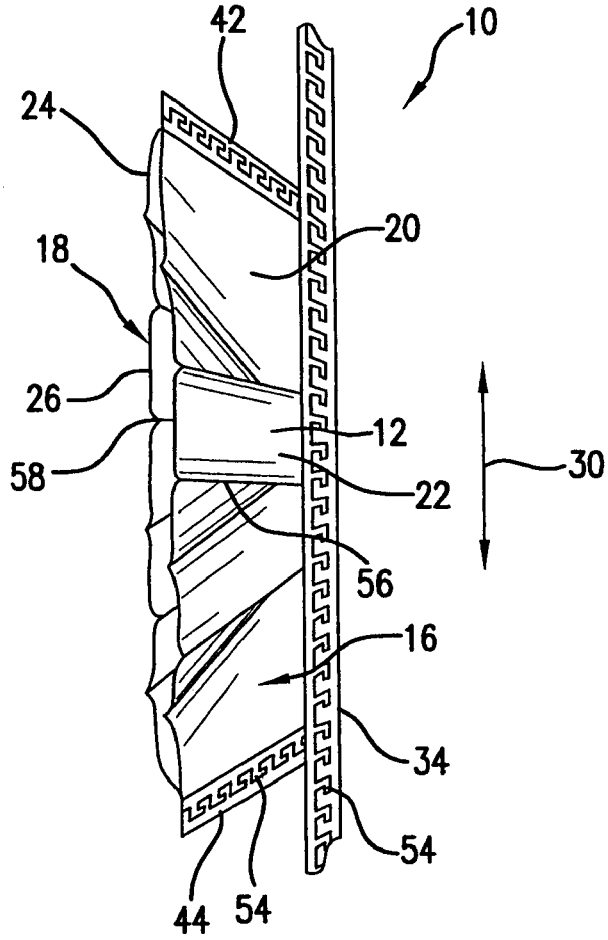
FIG. 6 is a partial perspective view of the body portion of FIG. 5 in the opened orientation.

FIG. 6 shows the layers 20 and 24 after unfolding of the folds 22 and 26. All of the first creases 56 are misaligned or unested with the second creases 58. Although some of the first creases 56 will intersect some of the second creases 58, complete alignment or nesting of the creases 56 and 58 is avoided thus rendering the body portion 12 more fluid resistant.

Figure 7:
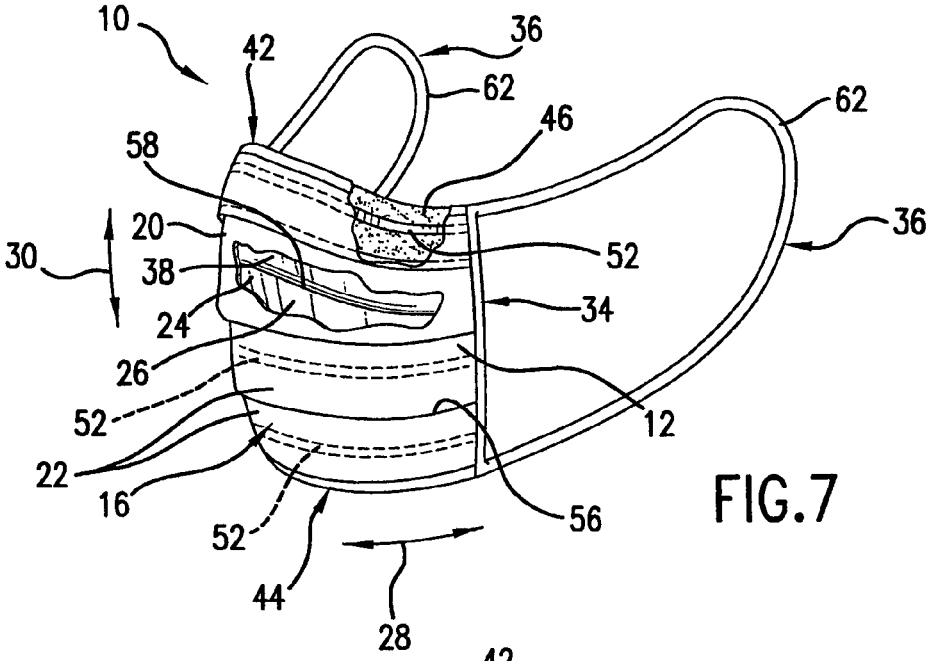
FIG. 7 is a perspective view of an exemplary embodiment of a face mask. The face mask includes an anti-fog strip and a fastening member that is a pair of ear loops.

In accordance with another exemplary embodiment, an anti-fog strip 46 may be attached to the second layer 24 and run along the horizontal direction 28 of the body portion 12 as shown in FIG. 7. The anti-fog strip 46 may be attached by way of the binding 42 or may be attached to the second layer 24 in any manner commonly known to one having ordinary skill in the art such as through adhesion or staples. The anti-fog strip 46 may assist in redirecting exhaled breath of the user 14 (FIG. 4) into the layers 20 and 24 of the body portion 12 and away from the eyes of the user 14. It is sometimes the case that exhaled breath will cause fogging of eye wear or a face shield if worn by a user 14. The anti-fog strip 46 may act to seal the periphery of the upper edge of the body portion 12 so that warm, moist exhaled breath cannot be directed therethrough. The anti-fog strip 46 may be configured as that shown in U.S.

Pat. No. 6,520,181 to Baumann, et al., the entire contents of which are incorporated herein by reference in their entirety for all purposes.

Figure 8:
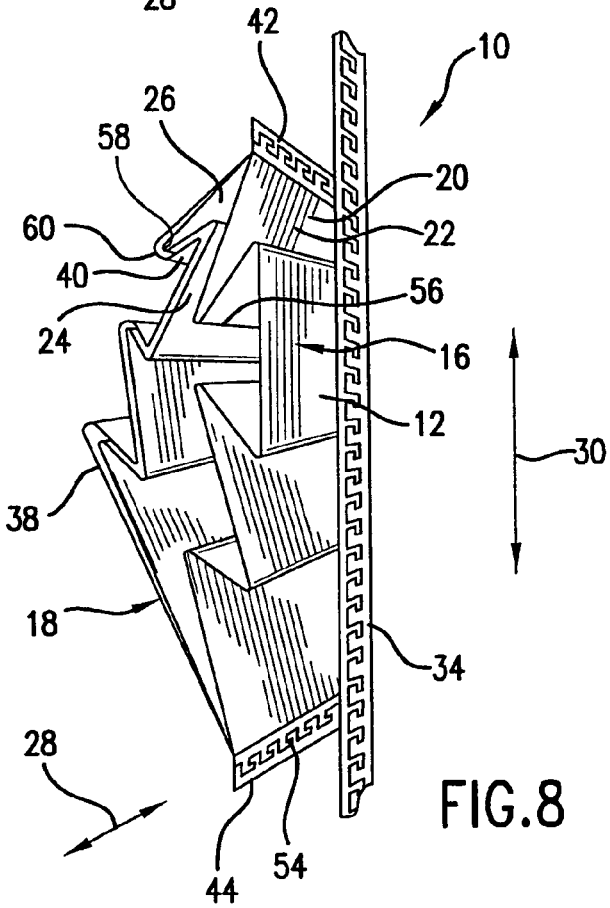
FIG. 8 is a partial perspective view of a body portion of the face mask in accordance with one exemplary embodiment in the closed orientation. The face mask includes three layers in which the second and third layers have creases that are aligned with one another and are misaligned with the creases of the first layer.
Figure 9:
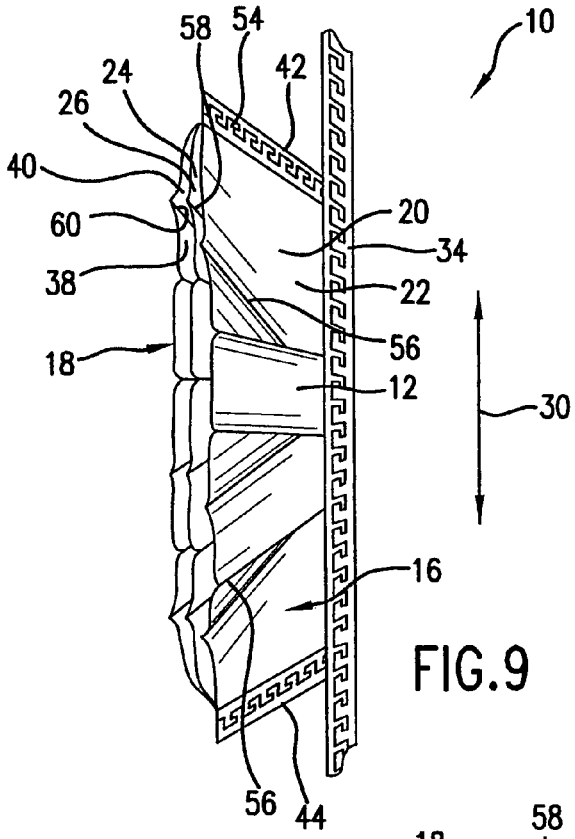
FIG. 9 is a partial perspective view of the body portion of FIG. 8 in the opened orientation.

FIG. 8 shows an exemplary embodiment in which a third layer 38 may be incorporated into the body portion 12. As with the first and second layers 20 and 24, the third layer 38 may have a plurality of folds 40 that run in the horizontal direction 28. A plurality of third creases 60 may be present in the folds 40 and may be aligned with or nested with the second creases 58 of the second layer 24. The first creases 56 of the first layer 20 are offset from and are not aligned with the second and third creases 58 and 60. The body portion 12 is shown opened in FIG. 9. The second and third creases 58 and 60 are aligned with one another but are vertically offset from the first creases 56 so that the body portion 12 will enjoy increased fluid resistance.

In accordance with another exemplary embodiment, the third creases 60 may be offset from both the first creases 56 and the second creases 58 so that all of the creases 56, 58 and 60 may be offset from one another. The creases 56, 58 and 60 may or may not intersect one another in accordance with various exemplary embodiments of the present invention. Further, in accordance with other exemplary embodiments, the first creases 56 may be aligned with the third creases 60 while both the first and third creases 56 and 60 are offset from the second creases 58. Still further, it is to be understood that in accordance with other exemplary embodiments that any number of additional layers may be employed that may or may not have folds that may or may not be aligned or nested with those of the first, second and third layers 20, 24 and 38.

Figure 10:
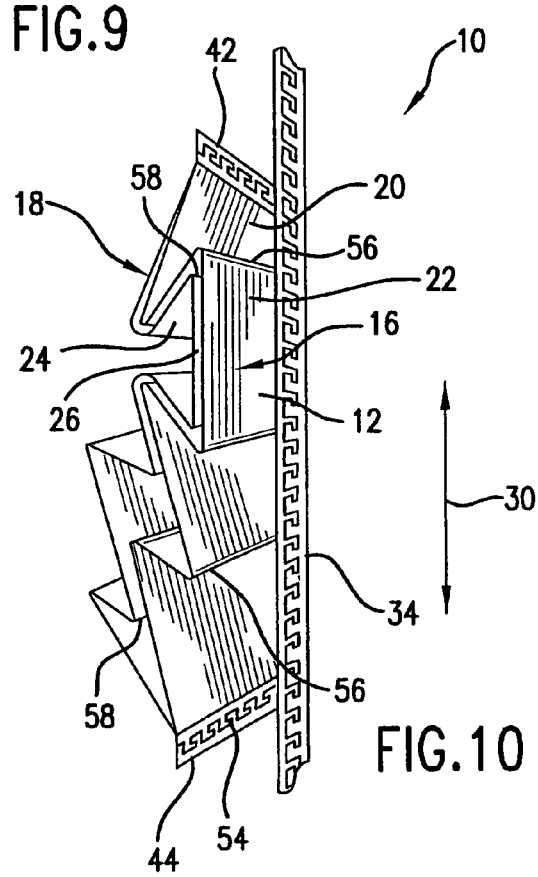
FIG. 10 is a partial perspective view of a body portion of the face mask in accordance with one exemplary embodiment in the closed orientation. The body portion includes two layers that have creases that are both aligned and misaligned with one another.
Figure 11:
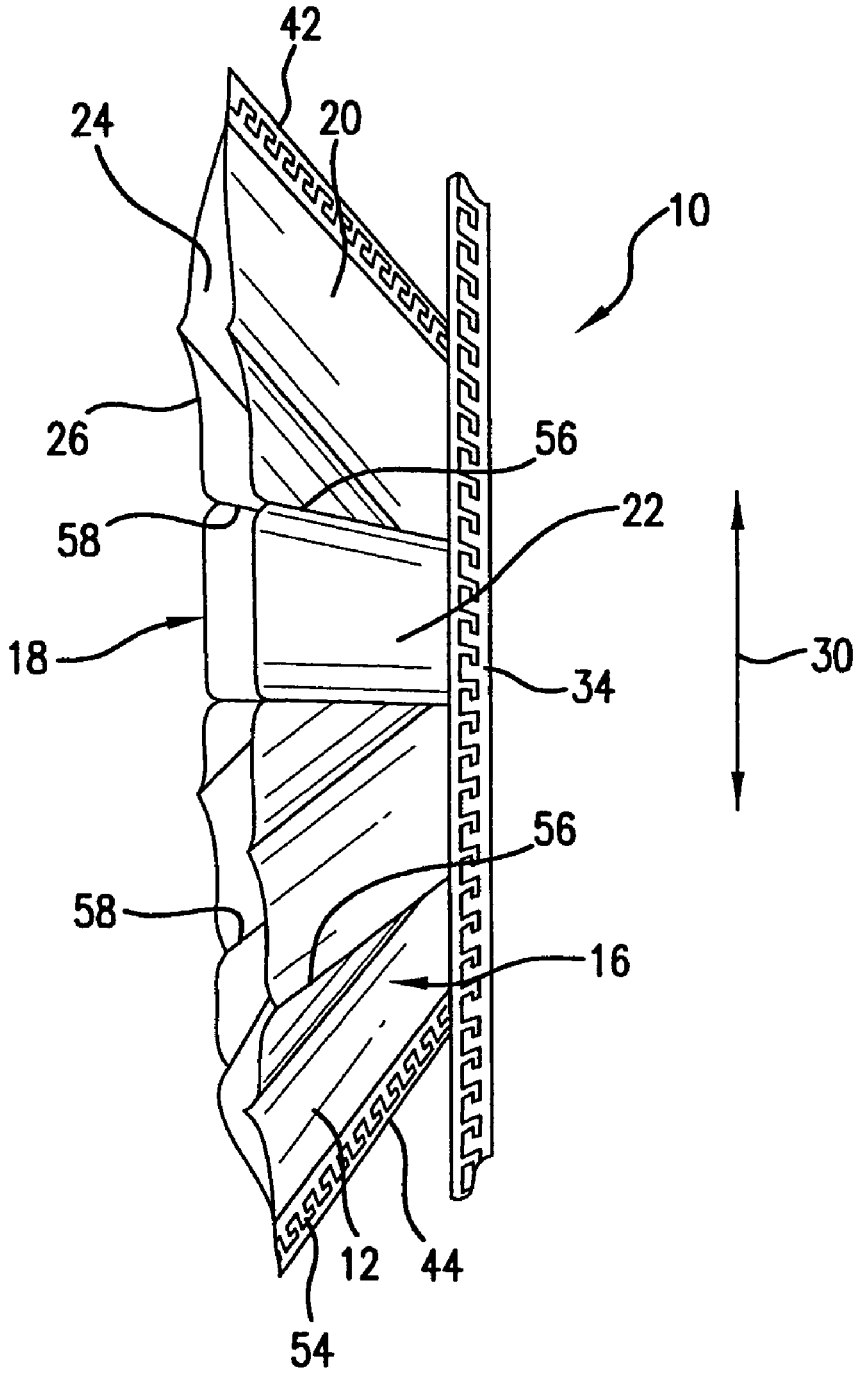
FIG. 11 is a partial perspective view of the body portion of FIG. 10 in the opened orientation.

FIG. 10 shows an exemplary embodiment of the body portion 12 of the face mask 10 in which a first and second layer 20 and 24 are present. In this exemplary embodiment, some of the first creases 56 may be aligned or nested with the second creases 58 while other first creases 56 may be misaligned or unnested with other second creases 58. FIG. 11 shows the body portion 12 of FIG. 10 in an unfolded orientation. Various exemplary embodiments are included in which certain first creases 56 may or may not be nested or aligned with certain second creases 58.

Figure 12:
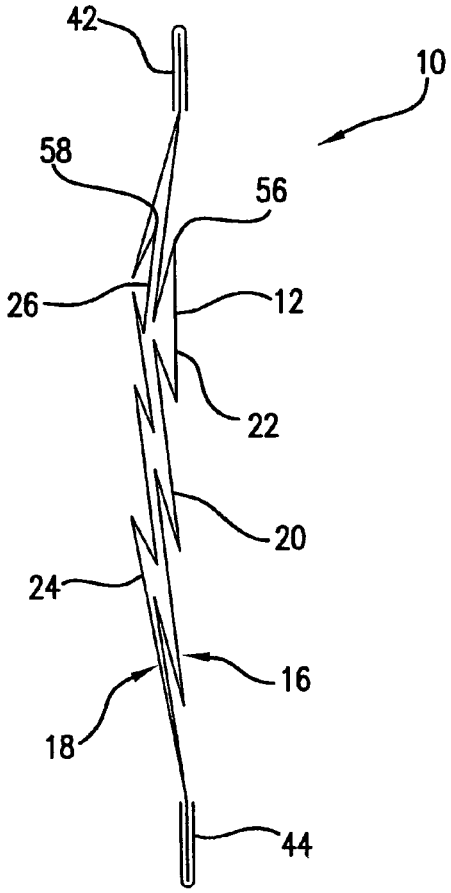
FIG. 12 is a perspective view of a method of forming a body portion in accordance with one exemplary embodiment. The first and second layers are assembled with one another and are fixed by way of a binding so that folds of the first and second layer are misaligned.

During construction of the body portion 12, in accordance with one exemplary embodiment, the first layer 20 and the second layer 24 may each pass through their own set of folding boards before the layers 20 and 24 are brought together and configured with one another. The design and alignment of the individual folding boards may be adjusted to ensure that a desired alignment of the first and second creases 56 and 58 is obtained. The folding boards may be situated so that the first layer 20 is folded vertically above or below the second layer 24. The layers 20 and 24 may then be brought into engagement with one another in one exemplary embodiment. FIG. 12 shows the layers 20 and 24 in contact and fixed to one another by way of bindings 42 and 44 in accordance with one exemplary embodiment. Of course, bindings 32 and 34 (FIG. 3) may also be added or used in another exemplary embodiment.

Figure 13:
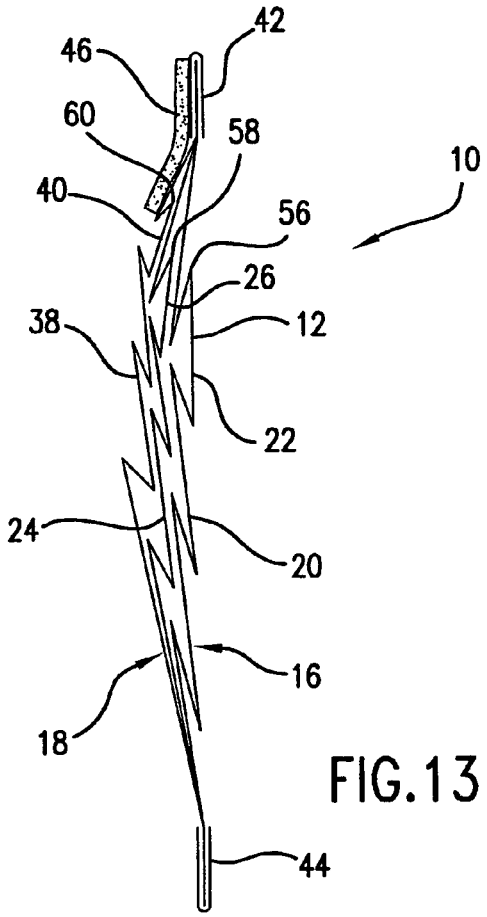
FIG. 13 is a perspective view of an exemplary embodiment of a method of forming a body portion. An anti-fog strip and a third layer are assembled onto the first and second layers.

Two additional steps that may be included are shown in FIG. 13 in which an anti-fog strip 46 may be attached to the first layer 20. Additionally, a third layer 38 that may be folded by one of the same folding boards responsible for folding the first layer 20 or the second layer 24 may also be provided and may be attached to the first and second layers 20 and 24 and thus incorporated into the body portion 12. In accordance with other exemplary embodiments, the third layer 38 may be folded via a separate folding board so as to result in a body portion 12 in which the first, second and third creases 56, 58 and 60 are misaligned or unnested with one another. Multiple layers of the face mask 10 may be joined by various methods, including adhesive bonding, thermal point bonding, ultrasonic bonding or by any other method commonly know to one having ordinary skill in the art.

Any of the layers 20, 24 and/or 38 may be a filtration media configured to prevent the passage of pathogens through the body portion 12 while still allowing for the passage of air in order to allow the user 14 (FIG. 4) to breathe. In one exemplary embodiment, just the second layer 24 is a filtration layer. As can be imagined, the layers 20, 24 and 38 may be configured so that any of the layers 20, 24 and 38 include filtration media. For instance, both the first layer 20 and the second layer 24 may include filtration media in accordance with one exemplary embodiment of the present invention. Although shown as having three layers 20, 24 and 38, the body portion 12 and/or the entire face mask 10 may be made of any number of layers in accordance with other exemplary embodiments.

It is to be understood, however, that the body portion 12 may be of a variety of styles and geometries, such as, but not limited to, flat half masks, pleated face masks, cone masks, duckbill style masks, trapezoidally shaped masks, etc. The styles shown in the Figures are for illustrative purposes only. The body portion 12 may be configured as that shown in U.S. Pat. No. 6,484,722 to Bostock, et al., the entire contents of which are incorporated by reference herein in their entirety for all purposes. The face mask 10 may isolate the mouth and the nose of the user 14 (FIG. 4) from the environment. Additionally, the configuration of the face mask 10 may be different in accordance with various exemplary embodiments. In this regard, the face mask 10 may be made such that it covers both the eyes, hair, nose, throat, and mouth of the user 14. As such, face masks 10 are included that cover areas above and beyond simply the nose and mouth of the user 14.

The face mask 10 may be attached to the user 14 by a fastening member 36 that may be a pair of tie straps 48 as shown in FIG. 4 that are wrapped around the head of the user 14 (and a hair cap 50 if worn by the user 14) and are connected to one another. It is to be understood, however, that other types of fastening members 36 may be employed in accordance with various exemplary embodiments. For instance, instead of the tie straps 48, the face mask 10 may be attached to the user 14 by a fastening member 36 that may be elastic bands wrapped around the head of the user 14, a hook and loop type fastener arrangement, a pair of ear loops, or a connection directly attaching the face mask 10 to the hair cap 50. FIG. 7 shows the fastening member 36 as a pair of ear loops 62 that may be fastened to the ears of the user 14 (FIG. 4) so as to retain the face mask 10.

The exemplary embodiment shown in FIG. 7 includes a series of structural elements (stays) 52 incorporated into the body portion 12 in order to provide for a face mask 10 with different desired characteristics. The stays 52 may provide for structural rigidity of the body portion 12, and may also be shaped in order to help seal the periphery of the body portion 12. Alternatively, a stay 52 may be employed within the body portion 12 in order to help conform the body portion 12 around the nose of the user 14 (FIG. 4). The stay or stays 52 may be used to help seal the perimeter of the body portion 12 around he face of the user 14 and/or to help maintain the shape of a breathing chamber and to keep the breathing chamber from contacting the face of the wearer.

Additionally, a stay 52 may be employed in order to better shape the body portion 12 around the chin of the user 14 (FIG. 4). The stays 52 may allow for a better fit of the body portion 12 and may be used to help form a chamber around the mouth and/or nose of the user 14. The stays 52 may help achieve a better fit so as to prevent the transfer of pathogens through any possible openings along the perimeter of the body portion 12. A series of stays 52 incorporated into a face mask 10 is disclosed in U.S. Pat. No. 5,699,791, to Sukiennik et al., the entire contents of which are incorporated herein by reference in their entirety for all purposes. Stays 52 may be made of an elongated malleable member such as a metal wire or an aluminum band that may be formed into a rigid shape in order to impart this shape into the body portion 12 of the face mask 10. Of course, various exemplary embodiments exist that do not include stays 52.

The face mask 10 may also incorporate any combination of known face mask 10 features, such as visors or shields, anti-fog strips 46, sealing films, beard covers, etc. Exemplary faces masks and features incorporated into face masks are described and shown, for example, in the following U.S. Pat. Nos. 4,802,473; 4,969,457; 5,322,061; 5,383,450; 5,553,608; 5,020,533; and 5,813,398. The entire contents of these patents are incorporated by reference herein in their entirety for all purposes.

As stated, the mask face 10 may be composed of layers 20, 24 and 38 as shown for instance in FIG. 8. These layers 20, 24 and 38 may be constructed from various materials known to those skilled in the art. For instance, the first layer 20 of the body portion 12 may be any nonwoven web, such as a spunbonded, meltblown, or coform nonwoven web, a bonded carded web, or a wetlaid composite. The second layer 24 of the body portion 12 and first layer 20 may be a necked nonwoven web or a reversibly necked nonwoven web. The layers 20, 24 and 38 may be made of the same material or of different materials. SMS may be used to comprise the layers 20, 24 and 38. SMS is a meltblown layer made of meltblown fibers, between two spunbond layers made of spunbond fibers.

Many polyolefins are available for nonwoven web production, for example polyethylenes such as Dow Chemical's ASPUN® 6811A linear polyethylene, 2553 LLDPE and 25355, and 12350 polyethylene are such suitable polymers. Fiber forming polypropylenes include, for example, Exxon Chemical Company's Escorene® PD 3445 polypropylene and Basell's PF-304. Many other suitable polyolefins are commercially available as are known to those having ordinary skill in the art.

The various materials used in construction of the face mask 10 may exemplarily include a necked nonwoven web, a reversibly necked nonwoven material, a neck bonded laminate, and elastic materials such as an elastic coform material, an elastic meltblown nonwoven web, a plurality of elastic filaments, an elastic film, or a combination thereof. Such elastic materials have been incorporated into composites, for example, in U.S. Pat. No. 5,681,645 to Strack et al., U.S. Pat. No. 5,493,753 to Levy et al., U.S. Pat. No. 4,100,324 to Anderson et al., and in U.S. Pat. No. 5,540,976 to Shawver et al, the entire contents of which are incorporated herein by reference in their entirety for all purposes. In an exemplary embodiment where an elastic film is used on or in the body portion 12, the film may be perforated to ensure that the user 14 (FIG. 4) can breathe through the body portion 12 if the face mask 10 is desired to be breathable in this location. Alternatively, the film need not be elastic in accordance with other exemplary embodiments.

The layers 20, 24 and/or 38 when configured as a filtration layer may be a meltblown nonwoven web and, in some embodiments, may be electret treated. Electret treatment results in a charge being applied to the layers 20, 24 and/or 38 that further increases filtration efficiency by drawing particles to be filtered toward the layers 20, 24 and/or 38 by virtue of their electrical charge. Electret treatment can be carried out by a number of different techniques. One technique is described in U.S. Pat. No. 5,401,446 to Tsai et al., the entire contents of which are incorporated herein by reference in their entirety for all purposes. Other methods of electret treatment are known in the art, such as that described in U.S. Pat. No. 4,215,682 to Kubik et al.; U.S. Pat. No. 4,375,718 to Wadsworth; U.S. Pat. No. 4,592,815 to Nakao; and U.S. Pat. No. 4,874,659 to Ando, the entire contents of these patents are incorporated herein by reference in their entirety for all purposes.

The layers 20, 24 and/or 38 may be made of an expanded polytetrafluoroethylene (PTFE) membrane, such as those manufactured by W. L. Gore & Associates. A more complete description of the construction and operation of such materials can be found in U.S. Pat. Nos. 3,953,566 and 4,187,390 to Gore, the entire contents of which are incorporated herein by reference in their entirety for all purposes. The expanded polytetrafluoroethylene membrane may be incorporated into a multi-layer composite, including, but not limited to, an outer nonwoven web first layer 20, an extensible and retractable layer, and an inner second layer 24 comprising a nonwoven web.

Additionally, the face mask 10, as shown for example in FIGS. 3 and 4, may be made of an elastic material that allows the face mask 10 to stretch in one or more directions. The use of an elastic material incorporated into the body portion 12 may allow for fuller coverage of the user's 14 face and provide for more flexibility in accommodating variously sized faces of the users 14. The face mask 10 may be stretched over the nose, mouth, and/or face of the user 14. Alternatively, the body portion 12 may be made of an inelastic material. As such, the material that makes up the face mask 10 may exhibit elastic or inelastic characteristics depending upon the user's 14 needs.

The body portion 12 of the face mask 10 may be configured so that it is capable of stretching across the face of the user 14 from ear to ear and/or nose to chin. The ability of the body portion 12 to stretch and recover may provide the face mask 10 with better sealing capabilities and a more comfortable fit than face masks 10 that have an inelastic body portion 12. In order for the body portion 12 to stretch and recover, the body portion 12 must have at least one layer or a material that has stretch and recovery properties. Additionally, the entire face mask 10 may be composed of a material that has stretch and recovery properties in other exemplary embodiments. In certain exemplary embodiments, the percent recovery may be about 15% and the percent stretch may be about 15-65%, in other embodiments the percent recovery may be about 20-40% stretch, and in still other embodiments the percent recovery may be about 25-30% stretch.

Elastomeric thermoplastic polymers may be used in the face mask 10 of the present invention and may include block copolymers having the general formula A-B-A' or A-B, where A and A' are each a thermoplastic polymer endblock which contains a styrenic moiety such as a poly (vinyl arene) and where B is an elastomeric polymer midblock such as a conjugated diene or a lower alkene polymer. Block copolymers of the A-B-A' type can have different or the same thermoplastic block polymers for the A and A' blocks, and the present block copolymers are intended to embrace linear, branched and radial block copolymers. Examples of useful elastomeric resins include those made from block copolymers such as polyurethanes, copolyether esters, polyamide polyether block copolymers, ethylene vinyl acetates (EVA), block copolymers having the general formula A-B-A' or A-B like copoly (styrene/ethylene-butylene), styrene-poly(ethylene-propylene)-styrene, styrene-poly(ethylene-butylene)-styrene, (polystyrene/poly(ethylene-butylene)/polystyrene, poly(styrene/ethylene-butylene/styrene) and the like.

One or more layers 20, 24 or 38, as shown for example in FIG. 8, of the face mask 10 may be made of a composite that is a neck bonded laminate in certain exemplary embodiments. The neck bonded laminate may utilize a necked material or a reversibly necked material. The necking process typically involves unwinding a material from a supply roll and passing it through a brake nip roll assembly at a given linear speed. A take-up roll or nip, operating at a linear speed greater than that of the brake nip roll, draws the material and generates the tension needed to elongate and neck the fabric. When a reversibly necked material is desired, the stretched material is heated and cooled while in a stretched condition. The heating and cooling of the stretched material causes additional crystallization of the polymer and imparts a heat set. The necked material or reversibly necked material is then bonded to an elastic material. Afterwards, the layer may be folded in order to form folds 22, 26 or 40. The resulting necked composite is extensible and retractable in the cross-machine direction, that is the direction perpendicular to the direction the material is moving when it is produced. Upon extension and release, the elastic material provides the force needed for the extended composite to retract.

In another exemplary embodiment, the composite making up one or more of the layers 20, 24 or 38 may be a stretch bonded laminate. A stretch bonded laminate is formed by providing an elastic material, such as a nonwoven web, filaments, or film, extending the elastic material, attaching it to a gatherable material, and releasing the resulting laminate. A stretch bonded laminate is extensible and retractable in the machine direction, that is the direction that the material is moving when it is produced. A composite with multiple layers may be formed by providing the elastic layer and the gatherable layers, and subjecting it to this process either simultaneously or stepwise. The stretch bonded laminate may also include a necked material that is extensible and retractable in the cross-direction such that the overall laminate is extensible and retractable in at least two dimensions. As an illustration, to construct a two-layer composite that is extensible and retractable in at least two dimensions, an elastomeric meltblown nonwoven web is provided, the elastomeric meltblown nonwoven web is then extended in the machine direction, and the necked spunbonded nonwoven material is attached to the elastomeric meltblown nonwoven web by thermal bonding while the elastomeric meltblown web is extended. When the biasing force is released, the resulting composite is extensible and retractable in both the cross-direction and machine direction, due to the extensibility of the necked material and the use of the stretch bonding process, respectively. The composite may then be folded in order to form folds 22, 26 or 40 and attached to or otherwise incorporated with one or more layers to make up the body portion 12. Alternatively, one of the layers of the composite may be folded with folds 22, 26 or 40 before attachment to the other layer of the composite having folds 22, 26 or 40 offset from the folds 22, 26 or 40 of the previous layer of the composite.

Additional examples of processes to make such composites are described in, but not limited to, U.S. Pat. No. 5,681,645 to Strack et al., U.S. Pat. No. 5,492,753 to Levy et al., U.S. Pat. No. 4,100,324 to Anderson et al., and in U.S. Pat. No. 5,540,976 to Shawver et al., the entire contents of which are incorporated herein by reference in their entirety for all purposes.

The composite may contain various chemical additives or topical chemical treatments in or on one or more layers, including, but not limited to, surfactants, colorants, antistatic chemicals, antifogging chemicals, fluorochemical blood or alcohol repellents, lubricants, or antimicrobial treatments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A face mask, comprising:

a body portion configured to be placed over a mouth and at least part of a nose of a user in order to isolate the mouth and the at least part of the nose of the user from the environment, wherein said body portion has a first layer with a plurality of folds forming a plurality of first creases and wherein said folds extend across the entire horizontal length of said first layer and are configured to unfold in order to extend the length of said first layer in the vertical direction, said folds in said first layer pointed in a first direction relative to said body portion, wherein said body portion has a second layer adjacent with said first layer and has a plurality of folds forming a plurality of second creases wherein said folds extend across the entire horizontal length of said second layer and are configured to unfold in order to extend the length of said second layer in the vertical direction, said folds in said second layer pointed in the same first direction as said folds in said first layer so as to unfold in the same direction as said folds in said first layer, wherein said first creases of said plurality of folds in said first layer are misaligned and unnested with said second creases of said plurality of folds in said second layer.

2. The face mask as set forth in claim 1, wherein said body portion has binding on the sides of said body portion so as to limit expansion of the edges of said first and second layers upon unfolding of said folds in said first and second layers.

3. The face mask as set forth in claim 1, further comprising a fastening member attached to said body portion and configured for retaining said body portion onto the face of the user.

4. The face mask as set forth in claim 3, wherein said fastening member is a pair of ear loops.

5. The face mask as set forth in claim 1, wherein said body portion has a third layer in contact with said second layer, wherein said third layer has a plurality of folds forming a plurality of third creases and wherein said folds extend across the entire horizontal length of said third layer and are pointed in the same first direction as said folds in said first and second layers and are configured to unfold in order to extend the length of said third layer in the vertical direction, wherein said third creases of said plurality of folds in said third layer are unnested with said plurality of first creases in said first layer.

6. The face mask as set forth in claim 5, wherein at least one of said layers is made of spunbond fibers and meltblown fibers.

7. A face mask, comprising:

a body portion with a first layer and a second layer wherein said first and said second layers have a plurality of folds pointed in the same direction relative to said body portion and forming a plurality of first creases in said first layer and a plurality of second creases in said second layer, said body portion having an outer facing surface and an inner facing surface opposite from said outer facing surface, and wherein at least one of said first creases is misaligned and unnested with at least one of said second creases.

8. The face mask as set forth in claim 7, wherein all of said first creases of said first layer are misaligned with said second creases of said second layer.

9. The face mask as set forth in claim 7, wherein all of said first creases in said first layer extend across the entire horizontal length of said first layer, and wherein all of said second creases in said second layer extend across the entire horizontal length of said second layer.

10. The face mask as set forth in claim 7, wherein said body portion has binding on at least two of the ends of said first and second layers.

11. The face mask as set forth in claim 7, further comprising a fastening member attached to said body portion and configured for retaining said body portion onto the face of the user.

12. The face mask as set forth in claim 11, wherein said fastening member is a pair of ear loops.

13. The face mask as set forth in claim 7, wherein said body portion has a third layer in contact with said second layer, wherein said third layer has a plurality of folds oriented in the same first direction as said folds in said first and second layers and forming a plurality of third creases, wherein said third layer forms said inner facing surface and said first layer forms said outer facing surface, and wherein at least one of said first creases of said first layer is misaligned with all of said third creases.

14. The face mask as set forth in claim 13, wherein said first layer and said third layer are made of spunbonded fibers, and wherein said second layer is made of meltblown fibers.

* * * * *